US006021535A

United States Patent [19]

Baus et al.

[11] Patent Number: 6,021,535

[45] Date of Patent: Feb. 8, 2000

[54] COMPUTER WORKSTATIONS

[76] Inventors: David M. Baus, 13509—127th Ave. SE., Snohomish, Wash. 98290; Gary T. Lobdell, 750 S. Malabar Dr., Camano Island, Wash. 98292; Kevin J. Gould, 1567 Goat Trail Loop, Mukilteo, Wash. 98275

[21] Appl. No.: 08/422,046

[22] Filed: Apr. 14, 1995

[51] Int. Cl.[7] ..... A47C 20/02

[52] U.S. Cl. ..... 5/632; 5/635; 5/648; 5/657; 297/377; 297/217.3

[58] Field of Search ..... 5/630, 632, 633, 5/634, 635, 652, 657, 503.1, 507.1, 624, 648; 297/337, 217.1, 217.3; 248/918, 176.3, 125.1

[56] References Cited

U.S. PATENT DOCUMENTS 1,336,197 4/1920 Clampett ..... 5/635 X
2,208,945 7/1940 Miller ..... 297/377 X
2,834,032 5/1958 Scott ..... 5/657 X
4,848,710 7/1989 Newman ..... 5/633 X
4,901,385 2/1990 Adolphson ..... 5/648 X
5,113,875 5/1992 Bennett ..... 5/648 X

FOREIGN PATENT DOCUMENTS 597921 5/1947 United Kingdom ..... 5/507.1

*Primary Examiner*—Michael F. Trettel

[57] ABSTRACT

Systems which allow one to operate a computer device from an ergonomically superior, recumbent position. Provision is made for supporting the computer device and the body parts of the operator at elevations and inclinations which make the computer device the most comfortable and ergonomically superior to operate.

5 Claims, 8 Drawing Sheets

COMPUTER WORKSTATIONS

TECHNICAL FIELD OF THE INVENTION

The present invention relates to computer workstations and, more particularly, to novel, improved computer workstations which allow an operator to operate a computer from a personalized, recumbent position, thereby avoiding the multiple physical problems attributable to the prolonged use of a computer in a sitting position.

BACKGROUND OF THE INVENTION

The invention and subsequent dominance of the computer as the approach of choice for accumulating and manipulating data has ushered in the revolutionary age of information. This technological advance has transformed the traditional workplace and, with it, the way in which people perform their daily work. At the same time, this revolution has brought about a number of office related injuries which differ significantly from those seen in past years.

In the past, the office employee performed a great variety of physical and mental activities allowing him/her the opportunity to change positions and postures and leave a desk many times during the course of the workday. The wide range of tasks required by a worker greatly reduced or precluded the adverse effects of prolonged sitting.

Today, with office environments dominated by the computer, the adverse effects of constrained sitting postures on the worker operating a visual display terminal (V.D.T.) have become increasingly clear. Today's V.D.T. operator may spend eight hours in one posture doing two tasks using only four muscles. The operator's movements are restricted, attention is concentrated on the screen, and the hands are linked to the keyboard. The highly repetitive nature of the tasks, coupled with the prolonged postures required of the V.D.T. operator, can lead to progressive musculoskeletal damage involving the spine and extremities. Reports of physical discomfort localized in the neck-shoulder-arm area are common. This is not surprising when one considers the energy involved in maintaining an upright work posture all day. The muscles at the neck and shoulders sustain a constant holding contraction which can compress blood vessels and nerves passing through the neck on their way to the arm. Restricted circulation and nerve irritability can also lead to pain in the neck and/or upper extremities.

One observing V.D.T. operators in the workplace is struck by the sitting posture the operators often assume. Most lean back and stretch out their legs. An extensive study by Grandjean et al. looked at preferred settings of adjustable V.D.T. workstations ("V.D.T. Workstation Design: Preferred Settings and their Effects", *Human Factors* 25, 161–175 (1983)). The results of this field study showed that the majority of the subjects preferred trunk inclinations of between 100 degrees and 110 degrees, and the subjects preferred to rest their forearms or wrists when proper arm support was available. The relaxed, reclining posture of the V.D.T. operator commonly observed does not correspond to the recommended upright trunk posture on which today's ergonomic chairs and workstations are based.

The multiple physical problems attributable to prolonged static loading (sitting postures) and repetitive motion are well documented and supported by the medical community. They are commonly referred to as: Cumulative Trauma Disorder (C.T.D.), Overuse Syndrome, and Repetitive Motion Injury. These acute and chronic impairments include:

1. Inflammation of tendon sheaths (tendinitis or peritendinitis; e.g., carpal tunnel syndrome);

2. Inflammation of the attachment points of tendons (lateral epicondylitis, e.g., tennis elbow);
3. Inflammation of the joints (arthritis);
4. Chronic degeneration of the joints (chronic arthrosis);
5. Painful induration of muscles;
6. Intervertebral disc troubles.

The enormity of the problem can be appreciated by addressing just one of the above listed disorders. It is estimated that 80 to 90 percent of the general population will experience back problems and resulting pain sometime in their lifetime. Next to the common cold and flu, a back injury is the reason most often cited for work absenteeism. Low back pain results in 27 million lost work days annually, and in excess of 25 billion dollars is spent annually in treating back injuries.

Cumulatively, the statistics for all C.T.D. claims are equally staggering. The National Institute of Occupational Safety and Health (N.I.O.S.H.) estimates that over 5 million people suffered cumulative trauma disorders in 1986, accounting for over 30% of the total worker compensation claims. In 1984, the American Academy of Orthopedic Surgeons reported C.T.D.-related medical costs and lost earnings totalled over $27 million.

SUMMARY OF THE INVENTION

Now invented and disclosed herein are new and novel computer workstations which eliminate the physical problems attributable to prolonged sitting at a computer terminal. These novel workstations allow a person to operate a desktop or laptop computer from a recumbent or supine position with the head, neck, and back of the operator supported by a wedge-type backrest with an adjustable inclination. The resting of the back against an inclined backrest transfers a significant portion of the trunk weight to the backrest and reduces the strain on the discs and muscles. Support of the head and neck in a recumbent position eliminates postural loading and static muscular efforts of the head, neck and shoulder complex.

The hips and knees of the operator are allowed to be positioned in varying degrees of flexion or extension by a supportive sling or pad. This contributes to a fully supported recumbent position, further minimizing or eliminating the static effects of gravitational loading on articular cartilage and the postural loading of the head, shoulder, neck complex, thus potentially reducing long-term osteoarthritic changes in spinal and extremity joints. Upper extremity support also decreases postural muscle work of the shoulder and repetitive muscular strain of the forearms and hands.

Applicants' novel workstations implement in unique fashion the findings of Nachemson and Morris (In Vivo Measurement Of Intradiscal Pressure. J. Bone Joint Surgery, 46A, 1964, pp. 1077–1092) of the intradiscal pressures generated in the course of various maneuvers and occupational activities. The results of this study clearly demonstrate that intradiscal pressures and therefore the potential for spinal injuries, is significantly reduced by assuming a supported, recumbent position. In addition, the supporting of the forearms and hands supported at the level of the heart facilitates the hydrostatic relationship between the heart and hands, providing optimum upper extremity circulation.

Quite aside from the foregoing, our novel computer workstations minimize, if not entirely eliminate, human error by gravity causing one to assume a comfortable, ergonomically correct posture. This is in direct contrast to the popular "ergonomic chairs" on the market today where the operator tries to sit in an upright posture with gravity working to oppose this position (thus the tendency to "slouch" into poor posture despite the support of the chair). Furthermore, the position promoted by the novel workstation disclosed herein simulates the rest position recommended by doctors for an individual recovering from a back injury. Therefore, the potential for earlier, safe return to work following a serious back injury and/or back surgery is enhanced. The resultant outcome is: decreased worker time loss, decreased pain and suffering of the returning worker, and overall decreased health care costs.

From a mechanical standpoint, the advantages of the present invention include:

1. availability at a relatively low cost;

2. total adjustability for body size, shape, and needs and for laptop and/or full-size computers;

3. low-weight and portability;

4. safety (a heavy computer monitor or hardware is never suspended above the operator).

Thus, the present invention provides an alternative to the sitting position which is superior and is based on sound biomechanical principles and research. Workstations employing its principles provide greater tolerance in today's progressively specialized and automated workplace and offer advantages in such important areas as cost, adjustability, safety, and portability.

The objects, features, and advantages of the invention will be apparent to the reader from the foregoing and the appended claims and as the ensuing detailed description and discussion proceed in conjunction with the appended claims.

DETAILED DESCRIPTION OF THE INVENTION

Figure 1:
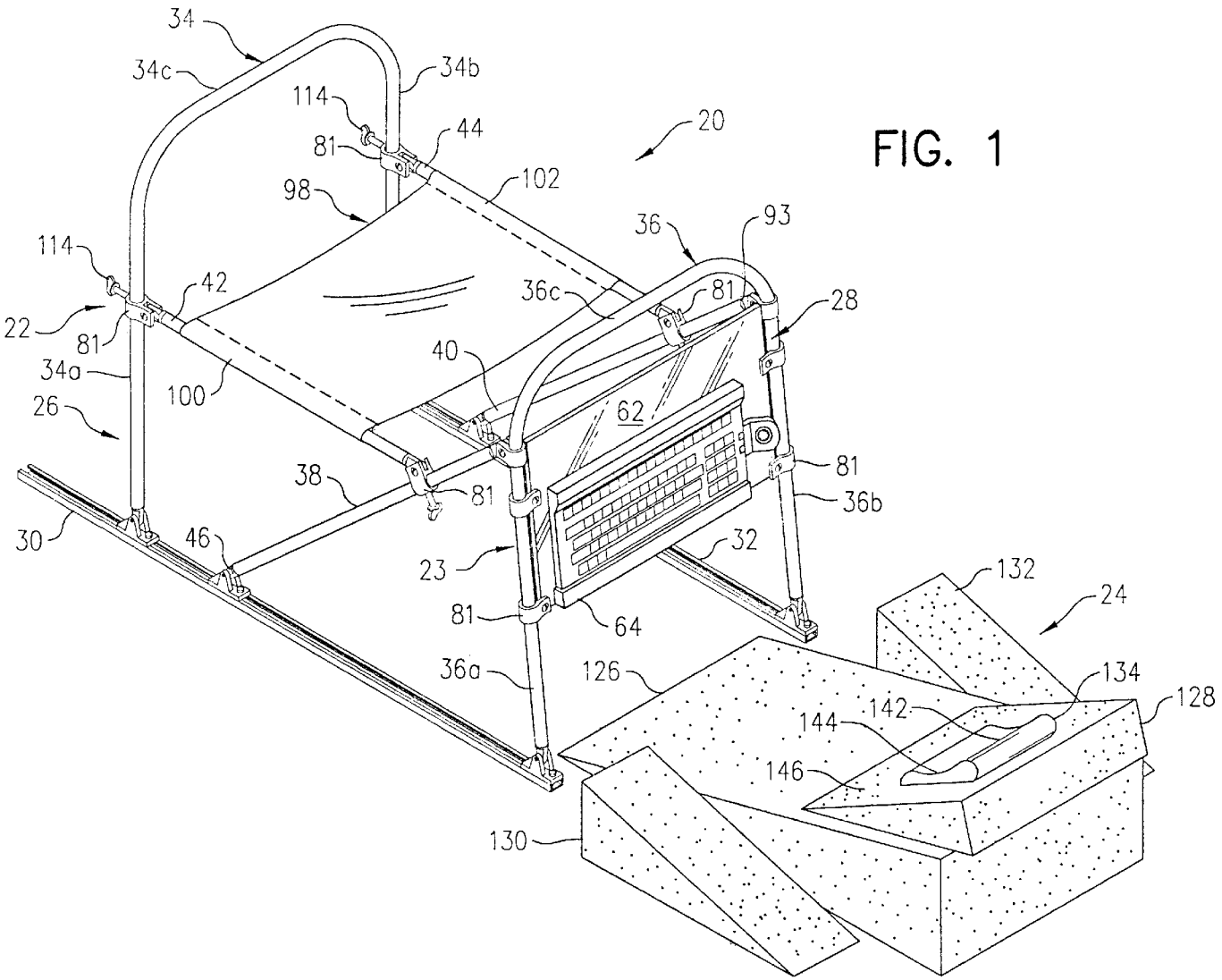
FIG. 1 is a generally pictorial view of a computer workstation constructed in accord with and embodying the principles of the present invention.

Referring now to the drawing, FIG. 1 depicts, a computer work station 20 constructed in accord with, and embodying, the principles of the present invention. The major components of the workstation are a collapsible system 22 for: (a) supporting the legs of a computer operator in an ergonomically correct, comfortable position; and (b) supporting a computer input device such as a keyboard or digitizer tablet or a portable, laptop, notebook, or other small computer such as the one identified by reference character 23 in FIG. 1 (The term "computer device" is employed generically herein to encompass both computers and computer input devices). Workstation 20 also includes an upper body support system 24 for supporting the back, neck, head, shoulders, and arms of a computer operator 25 (see FIG. 4) in positions which are also comfortable and ergonomically correct.

The major components of collapsible support unit 22 are a fold-up framework 26 and what will hereinafter be termed a "computer" support 28, it being understood that the latter can be employed to support either a computer per se or a computer input device: i.e., to support a computer device.

Collapsible, leg-supporting framework 26 is composed of two elongated tracks 30 and 32, U-shaped supports 34 and 36, braces 38 and 40, and horizontally oriented support members 42 and 44, all fabricated of aluminum, thin-wall steel tubing, or a comparable metallic or polymeric material.

Figure 4:
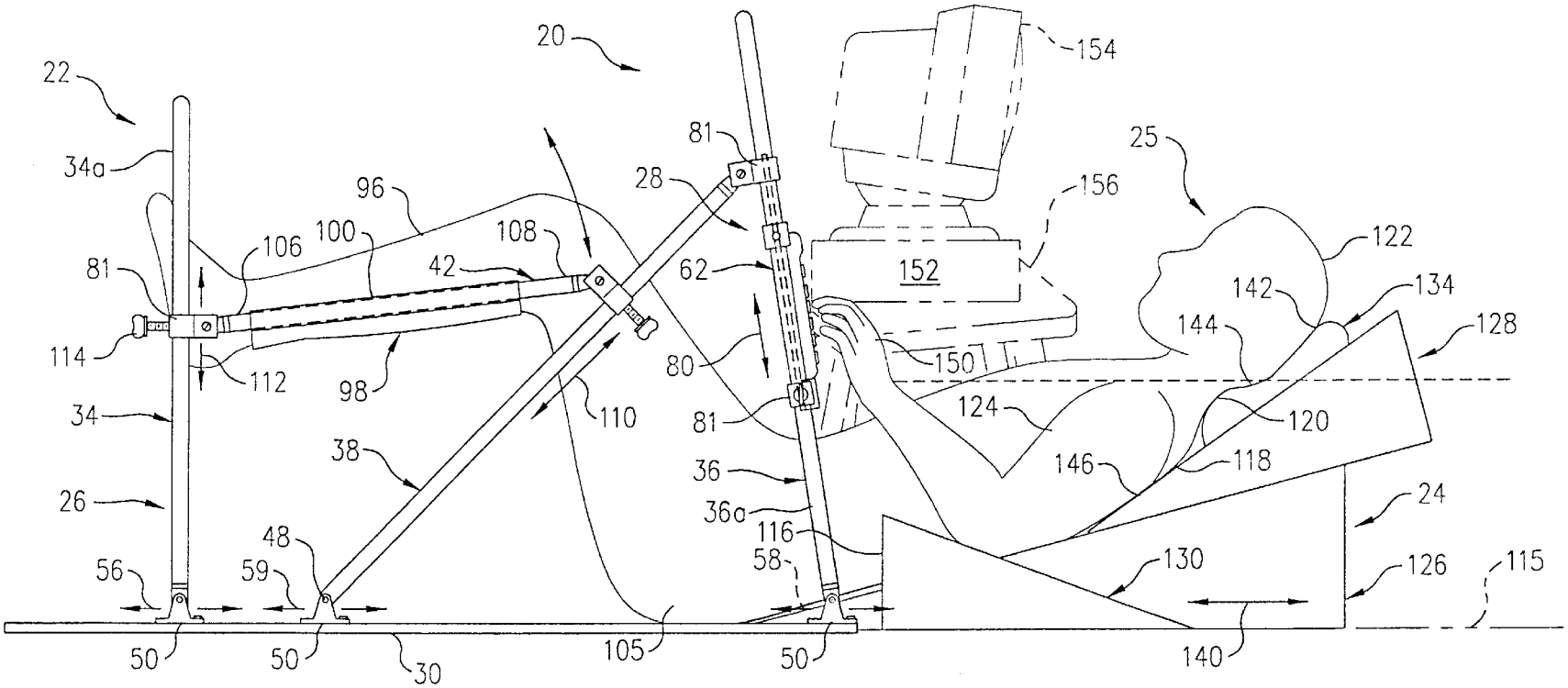
FIG. 4 is a side view of the workstation showing how the computer and the body of the computer operator are supported.

Tracks 30 and 32 rest on a floor or other supporting surface identified by reference character 45 (see FIG. 4). The U-shaped component 34 of system 22 has vertically oriented, parallel legs 34*a* and 34*b* spanned by a integral, horizontally oriented leg 34*c*; and the companion U-shaped component 36 has similarly oriented and related legs identified by reference characters 36*a,* 36*b,* and 36*c.*

Assembled to the lower, free end of each vertically oriented support component leg 34*a,* 34*b,* 36*a,* and 36*b* by a fitting 46 and a pivot pin 48 (see FIG. 2) is a slide 50, typically fabricated of a polymeric material with a low coefficient of friction. The slides 50 at the lower ends of U-shaped component legs 34*a* and 36*a* are trapped in and slidable along the channel 52 of rail or track 30, and the slides 50 at the lower ends of the support component legs 34*b* and 36*c* are similarly trapped in and slidable along a channel 54 in rail 32. This allows the U-shaped support components 34 and 36 to be displaced longitudinally along rails 30 and 32 as indicated by double-headed arrows 56 and 58 in FIGS. 2 and 4. Fasteners 60 threaded through slides 50 and engageable with tracks 30 and 32 lock U-shaped support components 34 and 36 to those tracks in the wanted positions therealong.

Computer support 28 includes a generally rectangular computer device support component 62. An elongated, transversely extending ledge or computer device rest 64 is fixed to the lower edge of support component 62. The computer device - - - i.e., a computer input device such as the keyboard 23 depicted in FIGS. 1 and 4 or a computer such as the one of the laptop type illustrated in FIG. 6 and identified by reference character 66 sits on rest 64 and butts against rectangular support component 62. Adhesive, Velcro, or other retainers 67 and 68 can be provided to hold the supported computer device against support component 62.

Figure 6:
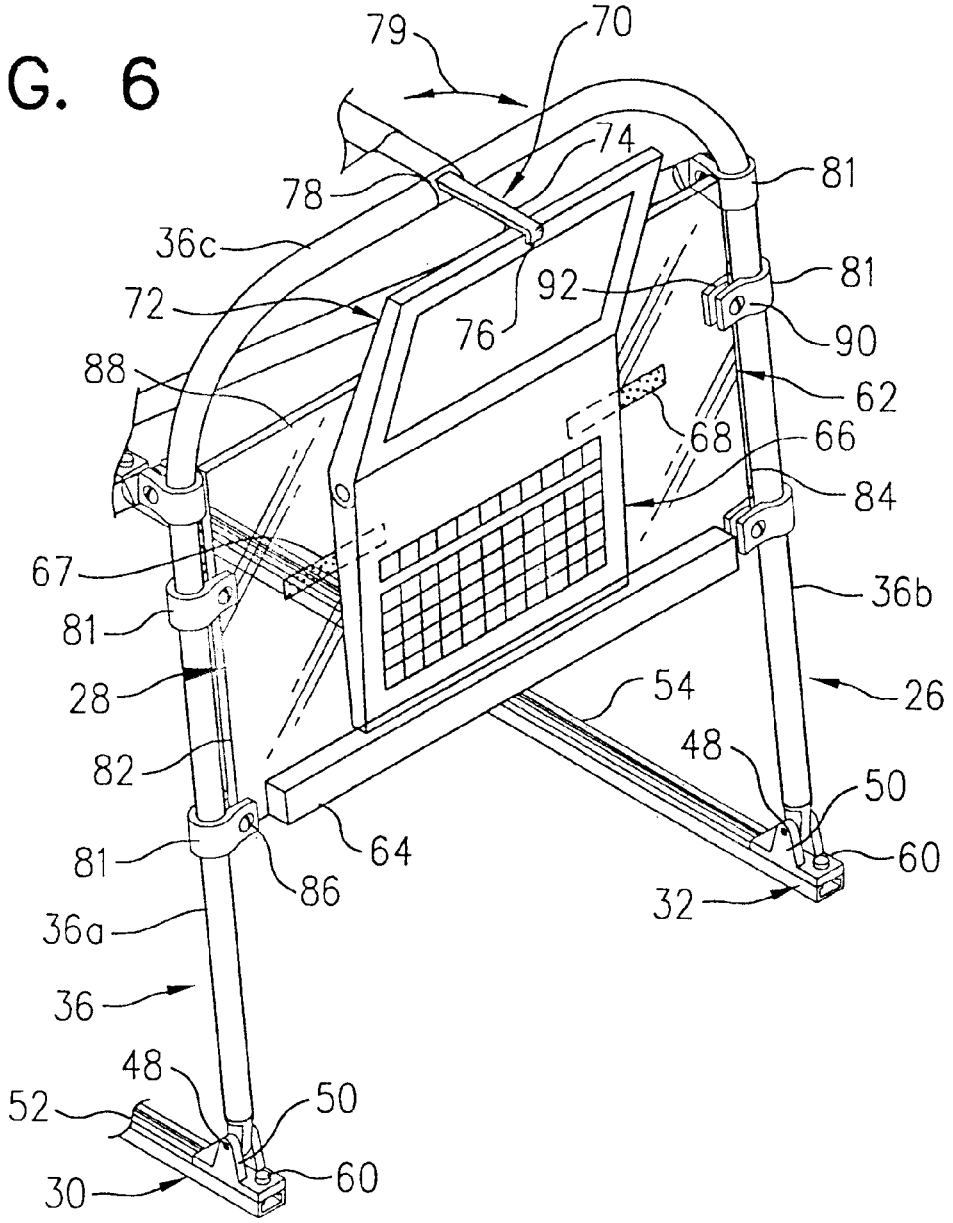
FIG. 6 is a fragmentary view of the FIG. 1 collapsible unit with an alternate computer-supporting arrangement.

Also, as shown in FIG. 6, a latch 70 can be provided to hold the monitor-incorporating cover 72 of the illustrated laptop computer 66 in the illustrated and operative position. Latch 70 includes a longitudinally extending, elongated arm 74 with an integral, cover-engaging catch 76 at one end. The opposite end of arm 74 is fixed to a sleeve 78 which surrounds the transversely extending, horizontal arm 36*c* of U-shaped support component 36. This allows latch 70 to be rotated about support leg 36*c* into engagement with computer cover 72 and into an out-of-the way storage position as indicated by double-headed arrow 79 in FIG. 6.

Computer device support 62 is slidably mounted to the vertically extending legs 36*a* and 36*b* of U-shaped component 36 for movement up-and-down as shown by arrow 80 in FIG. 4 to an elevation making the computer device comfortable to use by horseshoe-shaped clamps 81 located at the opposite, vertical edges 82 and 84 of computer device support component 62 and toward the lower and upper edges 86 and 88 of that component. Clamps 81 slidably surround support legs 36*a* and 36*b* of U-shaped component 36.

Component 36 consequentially positions computer device support 28 in an upright orientation and at an elevation appropriate to the input device or computer fixed to support 28 and the size, position, and other attributes of computer operator 25. The selected elevation is maintained by tightening clamp-associated screws 89. Each screw 89 extends through one leg 90 of the associated clamp 81 and is threaded into the complementary leg 92 to draw the legs together and thereby frictionally lock the clamp and computer device support leg together.

The computer or computer input device is held at the appropriate vertical angle θ by braces 38 and 40. The upper ends 93 of those braces are mounted to the vertically extending legs 36*a* and 36*b* of U-shaped support component 36 by clamps 81 of the character described above and locked at an appropriate elevation by the illustrated, associated threaded fasteners 89. Pivotably fixed to the lower ends 94 of braces 38 and 40 by male fittings 95 are track-mounted slides 50. Those slides are of the character described above in conjunction with reference character 50, and they are connected to the braces by fittings 46 and pivot members 48.

With the upper ends 93 of braces 38 and 40 at an appropriate elevation, U-shaped support component 36 and computer device support 28 can be fixed at the wanted, appropriate angle θ by displacing slides 50 along tracks 30 and 32 as shown by arrow 59 in FIG. 4 and then locking the slides at the appropriate locations by tightening the slide-associated fasteners 60.

It will be remembered that unit 22 under discussion is also employed to support the legs 96 of the computer operator 25 in an ergonomically correct, comfortable inclination and at an elevation of that same superior character (see FIG. 4). The leg-supporting components of unit 22 include the above, briefly mentioned, longitudinally extending, support components 42 and 44 and a hammock or sling 98 which extends between and is supported by components 42 and 44.

Elongated, horizontally oriented, spaced apart, support members 42 and 44 of unit 22 extend through marginal tubular sleeves 100 and 102 at the opposite sides of hammock 98. This allows the hammock to sag slightly toward the longitudinal centerline 104 of the hammock as indicated by reference character d in FIG. 2. The result is that, with the buttocks 105 of operator 25 resting on surface 45 (see FIG. 4), the legs 96 of computer operator 25 are cradled and held together in a comfortable, ergonomically correct position against the pull of gravity, which would tend to spread the operator's legs apart as would be the case if they were rested on a rigid or semirigid flat surface, for example.

At their aft and forward ends 106 and 108, longitudinally extending, horizontal support members 42 and 44 are pivotably fixed to the vertically extending legs 34*a* and 34*b* of U-shaped support 34 and to angularly inclined braces 38 and 40 by clamps 81 as described above and identified by the same reference character.

Figure 2:
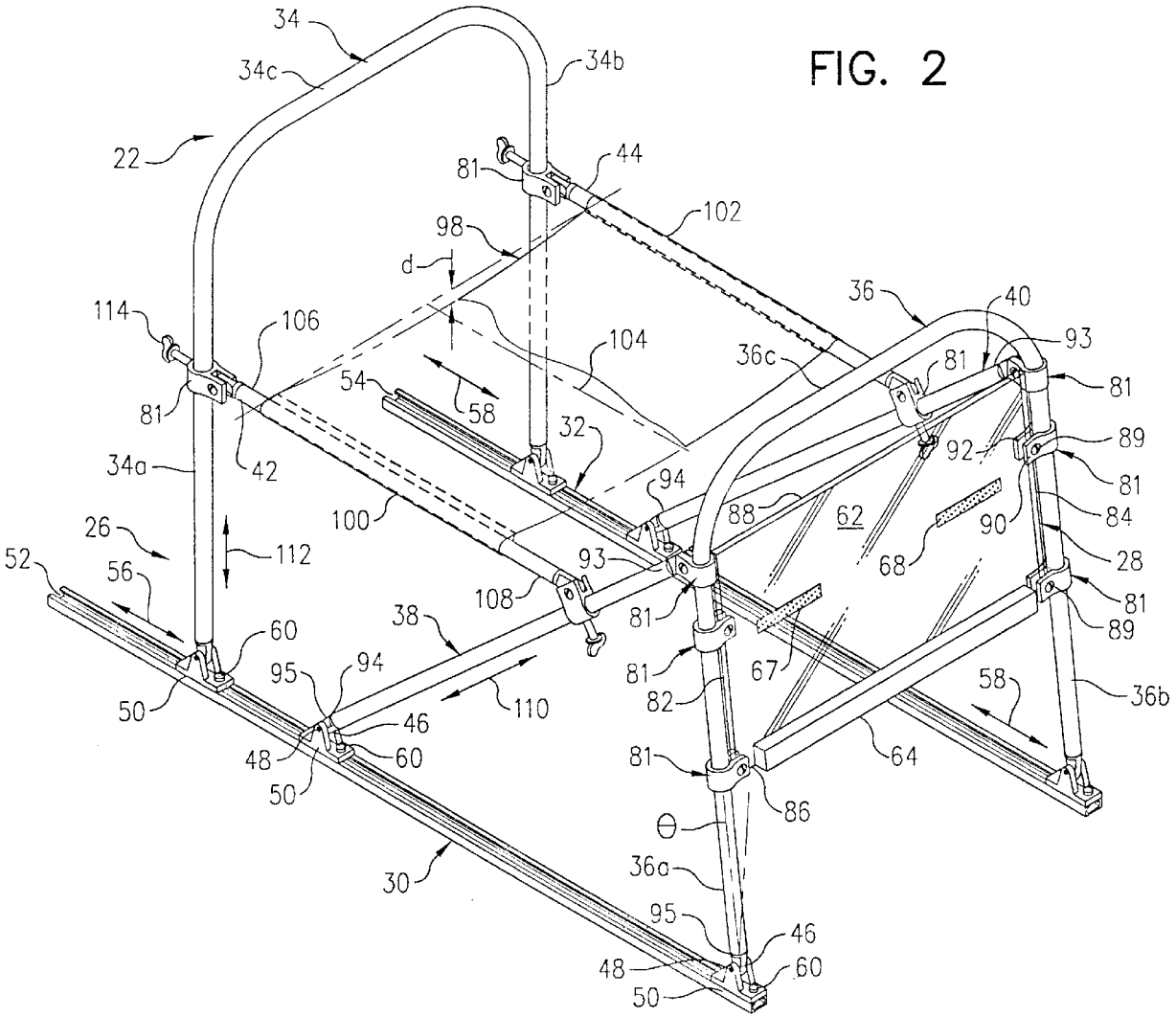
FIG. 2 is a pictorial view, to a larger scale, of a collapsible unit provided in the workstation of FIG. 1 to support a computer and the lower body of a computer operator.

By sliding the clamps 81 at the forward and aft ends of support unit 22 up and down on inclined braces 38 and 40 and up and down the vertically extending legs 34*a* and 34*b* of U-shaped support 34 as indicated by arrows 110 and 112 in FIG. 2, sling or hammock 98 can be located at an elevation and in an inclination in which it supports the legs 96 of operator 25 in a comfortable, ergonomically superior position. Clamps 81 are clamped to braces 38 and 40 and to support legs 36*a* and 36*b* by tightening the thumbscrews 114 threaded through those components into engagement with the associated braces and support legs.

Unit 22 is collapsed for transport and storage by: (1) loosening fasteners 60 and 114; and (2) then folding U-shaped support components toward each other and toward rails 30 and 32, typically after the components 126 . . . 146 of upper body support system 24 have been stowed beneath sling 98.

Figure 3:
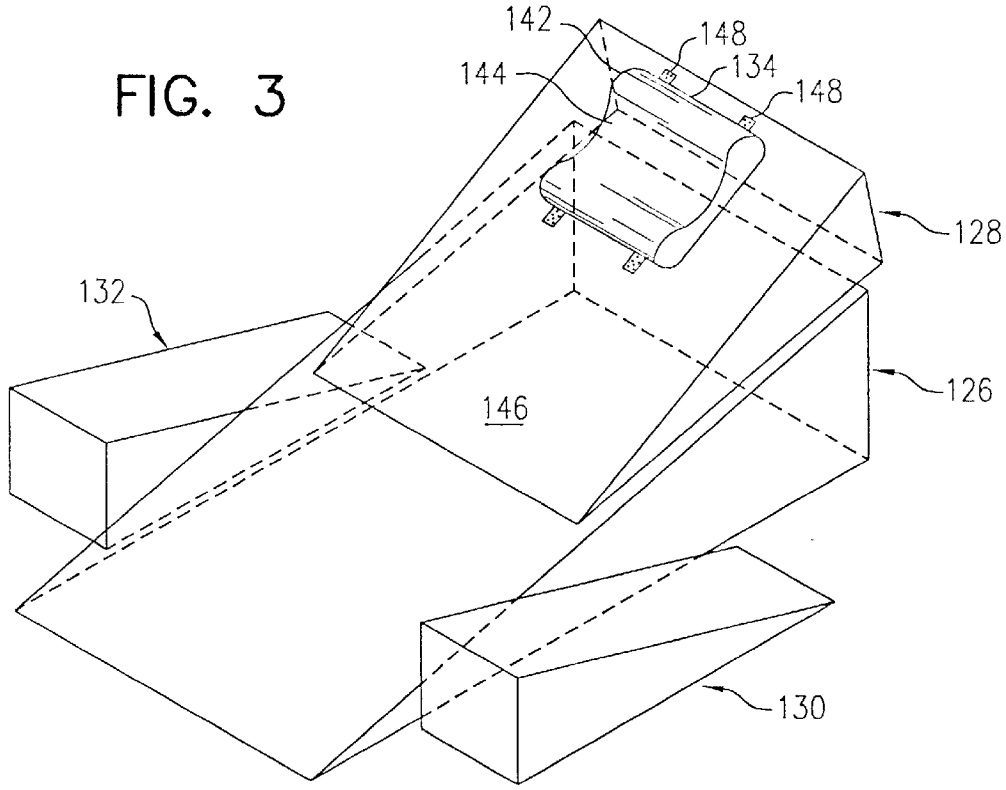
FIG. 3 is a pictorial view of an adjustable wedge system employed in the workstation of FIG. 1 to support the upper body of the computer operator.

Referring now to FIGS. 2–4, the system 24 utilized in association with unit 22 to support the back 116, shoulders 118, neck 120, head 122, and arms 124 of computer operator 25 includes a set of four wedges 126, 128, 130, and 132 and a headrest 134, all fabricated from a resilient material which is typically a polymeric foam covered with a non-slip fabric. Wedges 126 . . . 146 fit within collapsed support system 22, making workstation 20 easy to handle and transport.

In operation, wedge 126 is placed on the same supporting surface 136 as support unit 22, with its pointed end facing the support the unit. Head-, back-, and shoulder-supporting wedge 128 is similarly oriented and is seated on wedge 126.

Back-supporting wedge 126 is moved toward and away from support unit 22 as indicated by double-headed arrow 140 in FIG. 4 to a position in which it supports the lower back 116 of computer operator 25 in a comfortable, ergonomically correct position. Wedge 128 is shifted in an arrow 140 direction relative to wedge 126 to support the upper back and shoulders 118 of computer operator 25 in a similarly comfortable and ergonomically superior position.

Head and neck support (or headrest) 134 has a convex segment 142 which supports the neck 120 of computer operator 25 and an adjacent, concave segment 144 in which the head 122 of the computer operator rests. This element of system 24 is seated on the upper surface 146 of upper back-, head-, neck-, and shoulder-supporting wedge 128 and is shifted, also in an arrow 140 direction, to the position found most comfortable by computer operator 25. It is retained in the selected location as shown by the illustrated Velcro fasteners 148 (see FIG. 3).

Arm-supporting wedges 130 and 132 are positioned on supporting surface 136 on opposite sides of torso-supporting wedge 126 with the pointed ends of the arm-supporting wedges facing away from support unit 22 of workstation 20. The wedges are also shifted in an arrow 140 direction, in this case to locations in which the arms 124 of computer operator 25 are supported with the operator's hands 150 positioned for comfortable operation of computer device 23.

As was mentioned above, workstation 20 makes a computer safe to operate because no heavy components are positioned above the body of operator 25 and because the only device so positioned - - - an input device or a laptop or smaller computer - - - is so light as to not injure the operator, even in the unlikely event that it is jarred loose or otherwise separated from computer device support 28. If it is a heavier computer that is being employed, only the input device is affixed to support 28 with the remaining heavier components - - - central processing unit 152 and monitor 154 - - - being positioned adjacent workstation 20 on an appropriate supporting device such as the illustrated table 156.

Figure 5:
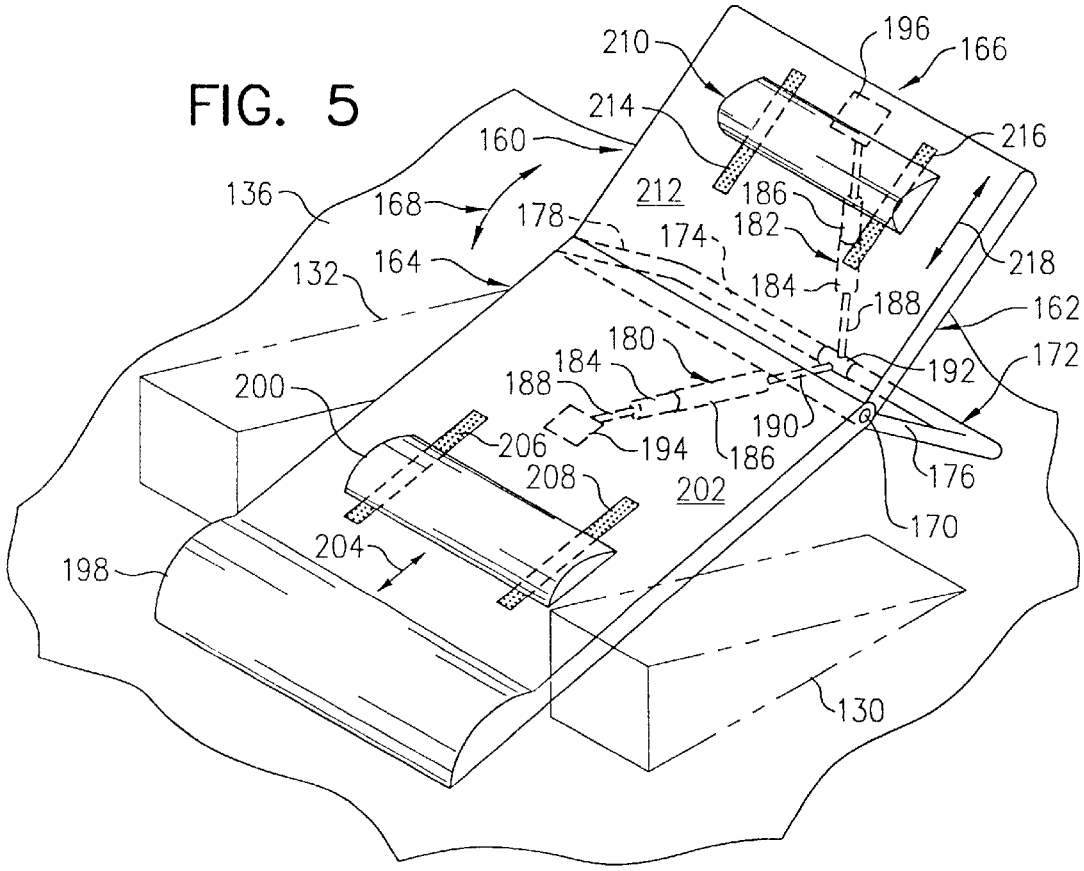
FIG. 5 is a pictorial view of a second system, which can be employed to support an operator's upper body in a workstation embodying the principles of the present invention.

Referring still to the drawings, FIG. 5 depicts an alternate upper body support unit 160 for supporting the back, shoulders, head, neck, and arms of a computer operator in a supine or recumbent position. This system includes a torso-, neck-, and head-supporting unit 162 and wedge-type arm supports 130 and 132 as described above.

Support unit 162 includes a torso-supporting component 164 and a shoulder-, neck-, and head-supporting component 166, both of which are rectangular, relatively thin members - - - typically fabric covered foam pads. Body-supporting components 164 and 166 are fixed together for movement toward and away from each other as indicated by double-headed arrow 168 by a transversely extending pivot member 170. Component 170 also pivotably connects a U-shaped brace 172 to the assembly of support components 162 and 164. Component 170 has a transverse leg 174 adapted to rest on supporting surface 136 and vertically extending legs 176 and 178 at the opposite sides of the body-supporting system 160 components 164 and 166.

Torso-supporting component 164 of unit 160 is supported at an appropriate angle to surface 136 and at a comfortable, ergonomically appropriate angle to component 162 by adjustable, elongated brackets 180 and 182. Those brackets are each composed of two telescoped elements 184 and 186 which can be fixed relative to each other by cooperating external and internal threads, or by pins or a comparable arrangement (not shown). Brackets 180 and 182 also include rodlike elements 188 and 190 extending in opposite longitudinal directions from the two telescoping bracket elements 184 and 186. The rods 190 of the two brackets are pivotably fixed in any convenient fashion to a sleeve 192 rotatably mounted on the transversely extending, supporting surface-engaging leg 174 of brace 172. The rods 188 of brackets 180 and 182 are pivotably fixed in like manner to attachments 194 and 196 mounted in any convenient fashion to the bottoms of torso and upper body-supporting components 164 and 166, respectively.

An integral, convex segment 198 is provided at the foot end of torso-supporting component 164, and a similarly configured support element 200 is positioned on the upper surface 202 of component 164. Integral segment 198 and component 200 provide ergonomically correct support for the lower and middle back of operator 25. Back support 200 can be positioned longitudinally along torso-supporting component 164 of system 160 as indicated by double-headed arrow 204, and it is fixed in the position to which it is adjusted as by the illustrated Velcro fasteners 206 and 208.

A convex, transversely extending neck support 210 is similarly attachable to the upper surface 212 of upper body support 166 by longitudinal extending Velcro fasteners 214 and 216. This allows neck support 210 to be displaced along component 166 in an arrow 218 direction to the location deemed most comfortable by the computer operator.

Figure 7:
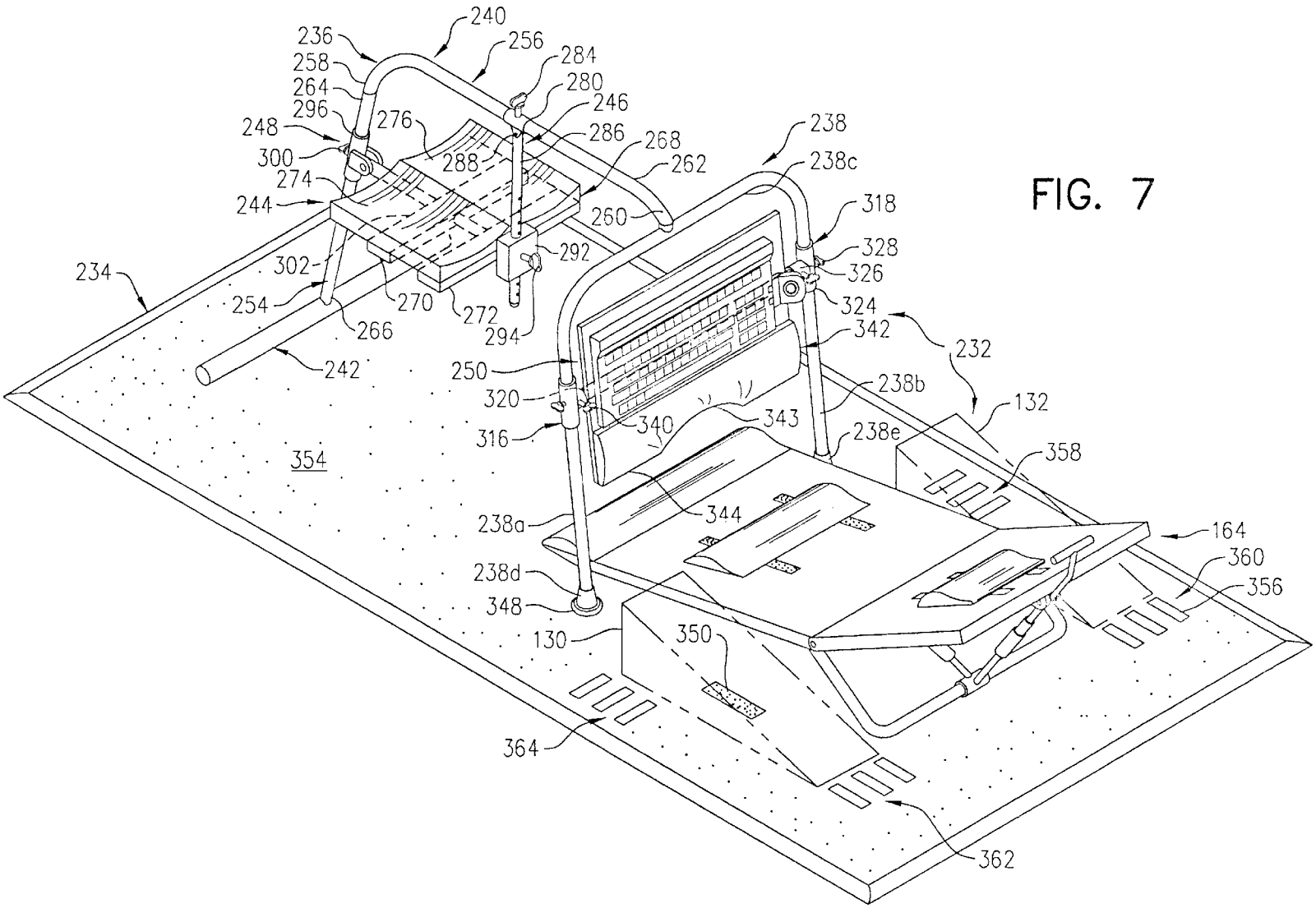
FIG. 7 is a perspective view of yet another computer support embodying the principles of the present invention; this figure also depicts a pad which can be employed to spot and/or anchor components of the support in locations optimal for a particular user.
Figure 8:
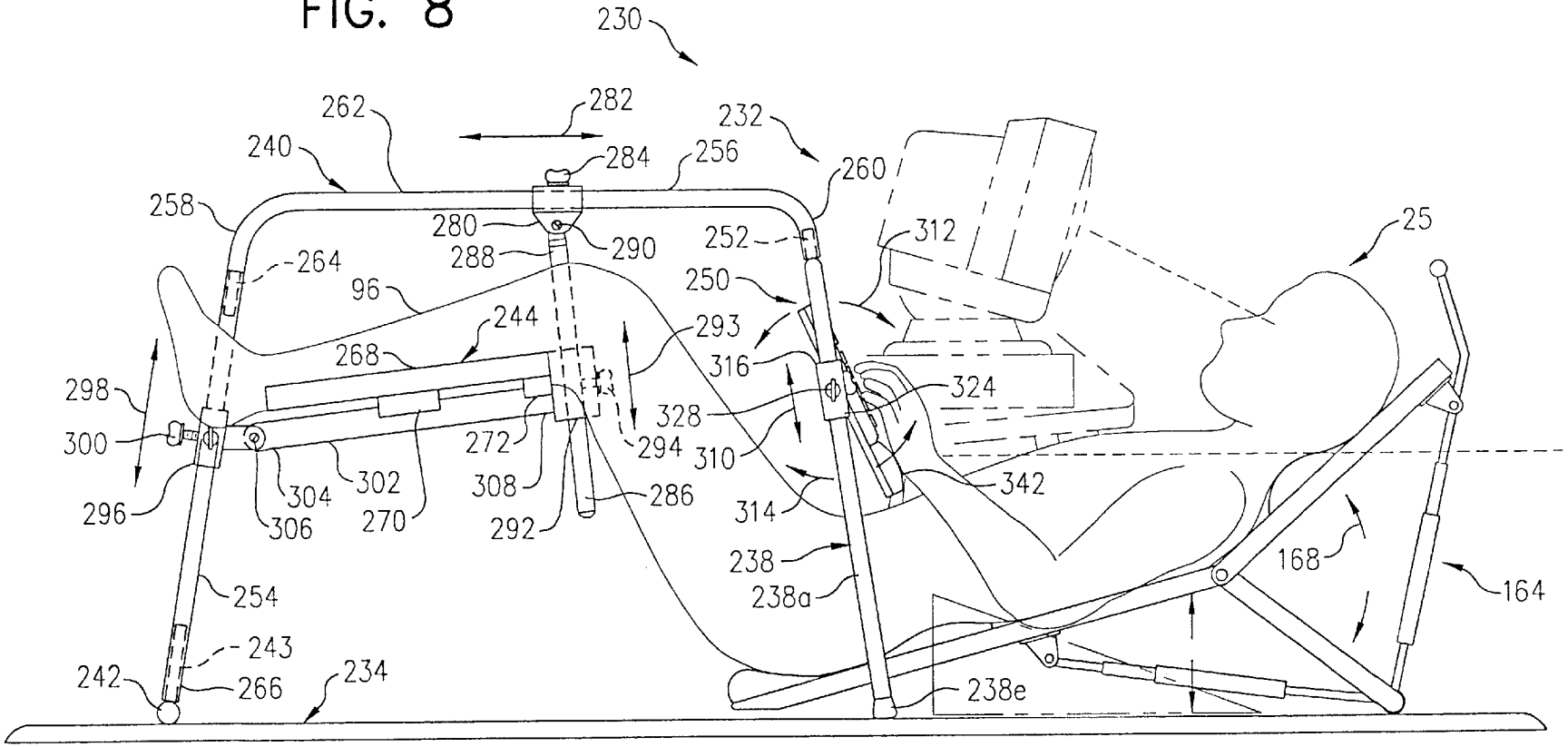
FIG. 8 is a side view of the FIG. 7 computer support and pad.

Referring still to the drawings, FIGS. 7 and 8 disclose yet another workstation 230 equipped with a computer and operator support system 232 which embodies the principles of the present invention and allows one to operate a computer in a recumbent position, thus reducing intradiscular pressures and lowering the risk of back injury. Additionally shown in FIGS. 7 and 8 - - - and also in FIG. 9 - - - is a novel nonskid floor pad 234 which can be employed to spot and anchor the components of computer support system 232 at locations providing optimal comfort and support for computer user 25.

Support system 232 includes a support unit 236 for the legs 96 of operator 25 and the computer device 23 - - - in this case, a conventional keyboard - - - , a torso support 164 of the character illustrated in FIG. 5, and arm supporting wedges 130 and 132 as shown in FIGS. 1 and 3–5.

Support unit 236 has the advantage over above-described support unit 22 that it is easier for operator 25 to use. This novel unit includes a transversely oriented, U-shaped support component 238; a longitudinally extending support component 240 with a transversely extending, pad- or floor-engaging member at its lower end, a support device 244 for the legs 96 of user 25, units 246 and 248 for suspending the support unit 244 from component 240, and a computer device support unit 250.

U-shaped component 238 has vertically extending legs 238*a* and 238*b* at opposite ends of a transversely oriented, upper, horizontally extending leg 238*c*. A fitting 252 extends upwardly from horizontal leg 238*c* at a locus equidistantly spaced from vertical legs 238*a* and 238*b*.

Support component 238 may be fabricated from the same types of hollow tubing as the components of the collapsible support unit 22 show in FIGS. 1 and 2 and discussed above.

The longitudinally extending component 240 of support system 232 can be fabricated from the same type of hollow tubing. That component includes a member 254 which extends vertically and is inclined at a slight angle toward support component 238 and a second, longitudinally extending, generally horizontal tubular member 256 with downwardly facing, integral segments 258 and 260 at opposite ends of the component's horizontal main segment 262. These end segments respectively fit over the upper end 264 of the just-described, vertically oriented member 254 and over the fitting 252 protruding from the horizontal leg 238*c* of U-shaped support 238, coupling support system framework components 238, 254, and 256 together. By virtue of this arrangement, support unit 236 can be disassembled for transportation and storage simply by removing component 256 from fitting 252 and component 254 and arranging the dissembled components of support unit 236 in a more compact arrangement.

Transverse support component 242 is fixed via an integral, upstanding fitting 243 to the lower end 266 of tubular member 254. Component 242 keeps component 240 and the leg support 244 suspended therefrom from tilting side-to-side.

The support unit 244 for the legs 96 of user 25 includes a leg-supporting component 268 mounted on longitudinally spaced, transversely oriented braces or supports 270 and 272. Support or pad 268 can be fabricated from the same, comfort-affording, resilient material as arm supports 130 and 132. It has juxtaposed, longitudinally extending concavities 274 and 276 which face upwardly and give lateral support to the legs 96 of user 25.

The unit 246 employed in conjunction with unit 248 to suspend support 244 from system component 240 includes a fitting 280 slidably mounted on support member 256 as indicated by double-headed arrow 282 in FIG. 8, a thumbscrew 284 which can be tightened to immobilize fitting 280 at a selected location along member 256, a vertically oriented, elongated member 286 pivotably fixed at its upper end 288 to fitting 280 by a pin 288, a support fitting 292 which can slide up and down on elongated member 286 as indicated by double-headed arrow 293 in FIG. 8, and a thumbscrew 294 for clamping support fitting 292 to elongated member 286 at a selected vertical location therealong.

The complementary unit 248 for suspending leg support 244 includes a fitting 296 vertically slidable on support member 254 as indicated by double-headed arrow 298 in FIG. 8. Support fitting 296 can be locked at a selected elevation by tightening thumbscrew 300.

An elongated, longitudinally extending support component 302 is pivotably fixed at its forward end 304 to fitting 296 as by pivot pin 306. Component 302 extends toward the U-shaped component 238 of support unit 232 through the support members 270 and 272 for leg support 244 with its rear end 308 fitting into the above-discussed, vertically displaceable, fitting 292 slidably mounted on vertically extending support element 286.

By adjusting the just-discussed fittings 292 and 296 of support unit 232 vertically and fitting 280 longitudinally along member 256, the support 244 for the user's legs 96 can be immobilized at an elevation and angle providing optimal support and comfort for user 25. These displaceable support components or fittings also allow the assembly consisting of longitudinal, tubular support member 240 and the several system components mounted to or suspended from that element to be collapsed into a compact configuration for transportation and storage.

Referring still to FIGS. 7 and 8, collapsible support unit 236 also differs from its FIG. 1 counterpart in that the computer device support component 28 of unit 236 can be both: (1) moved vertically to the optimal location for a particular user 25 as indicated by double-headed arrow 310 in FIG. 8 and as discussed above in conjunction with the FIG. 1 embodiment of the invention, and (2) rotated vertically as indicated by double-headed arrows 312 and 314 in the same figure.

These several degrees of motion are provided by the illustrated arrangement of vertically displaceable support fittings 316 and 318 and transversely extending, tubular support component 320.

The two, vertically displaceable fittings 316 and 318 may be identical. Each includes a tubular element 324 slidable up-and-down on an associated leg 238*a* or 238*b* of U-shaped support member 238 in an integral, inwardly facing socket 326. The ends of crosspiece 320 are rotatably fitted into sockets 326, and computer device support 28 is mounted in any convenient manner to the crosspiece. Thumbscrews 328 are employed to immobilize the computer device component 28 at a user-selected elevation, and complementary thumbscrews 340 are employed to lock the support and therefore computer device at the angle found most comfortable by user 25.

As indicated above, computer- and leg-supporting unit 232 may be considered by many to be more user friendly than the comparable unit 22 identified in FIG. 1. This is in part because the centrally located support arrangement for leg support 244 allows the user to move his legs 96 to the side and lift them onto support pad 268 one at a time with ease whereas the vertical legs 34*a* and 34*b* of the system 22 support component 34 virtually demands that both legs 96 be lifted simultaneously onto the hammock 98 of system 22.

The pivotable support arrangement discussed above for computer device support 28 also facilitates the lifting of the user's legs 96 onto support pad 268 as it can be tilted to a horizontal position to facilitate the movement of the user's legs.

Support system 232 also differs from its FIG. 1 counterpart by the addition of a pad 342 with a concave, leg-accommodating cutout 343 at its lower edge 344 to computer support device 28. Should user 25 inadvertently bump support 28, his legs 96 will engage the relatively soft and resilient pad 340 rather than the hard and rigid component 28.

Figure 9:
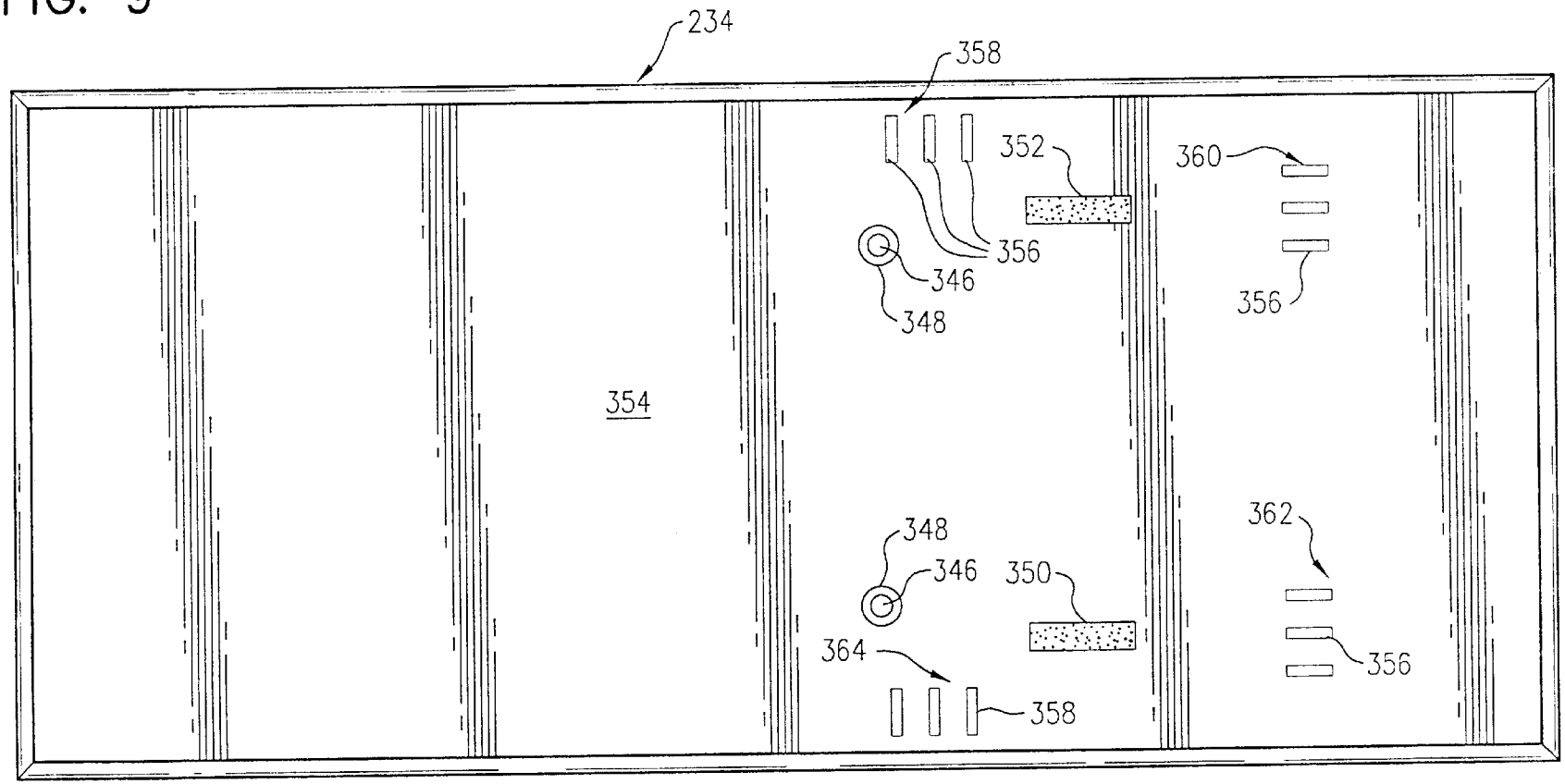
FIG. 9 is a plan view of the pad.

Referring still to FIGS. 7 and 8 but most particularly to FIG. 9, the floor pad 234 alluded to briefly above is optionally employed to immobilize the units and components 232, 164, 130, and 132 of computer support system 232 at the relative locations found optimally comfortable by a particular user 25. Pad 234 can be fabricated of any skid- and wear-resistant material. Holes 346 are punched through pad 234 and grommets 348 are installed in these holes. As shown in FIG. 8, the bumpers 238*d* and 238*e* at the bottom ends of the transversely spaced, vertical legs 238*a* and 238*b* of U-shaped support system component 238 are fitted into grommetted apertures 346 to position support unit 236 on pad 234. Arm supports 130 and 132 are held in place at selected locations on pad 234 by Velcro fasteners having components 350 and 352 fixed in any convenient manner to the upper surface 354 of pad 234 and complementary components (not shown) on the bottoms of the arm supports. Locator marks 356 arranged in four sets 358 . . . 364 of three enable the user to accurately position arm supports 130 and 132 at the wanted longitudinal and spanwise locations on pad 234. To this end, the locator marks 356 in sets 358 and 364 are spaced longitudinally along the pad whereas those locator marks 358 in sets 360 and 362 are spaced transversely.

The invention may be embodied in many forms without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. Apparatus enabling a computer device to be used by an operator in a recumbent position, said apparatus comprising:

support means for said device, said support means having means for adjusting the elevation of the device above, and the inclination of the device relative to, a reference surface; and body support means for the operator's legs, back, shoulders, arms, and head, said body support means comprising means for adjusting the elevation and/or inclination of a supported body part relative to the reference surface;

the device support means and body support means for the operator's legs being provided by a computer support device unit, and the body support means for the operator's back, shoulders, arms, and head being physically distinct and separate from and displaceable relative to said computer device support unit.

2. Apparatus which enables a computer device to be used by an operator in a recumbent position, said apparatus comprising a support unit with:

framework means;

means for supporting said computer device, said device supporting means including means displaceably mounted to said framework means for adjusting the height of the device above and the inclination of the device relative to a reference surface; and means for supporting the legs of the operator, said leg supporting means comprising means slidably supported by said framework means at first and second ends of said leg supporting means for adjusting the inclination of the operator's upper and lower legs relative to the reference surface and the height of the operator's lower legs above that surface.

3. Apparatus enabling a computer device to be used by an operator in a recumbent position, said apparatus comprising:

support means for said device, said support means having means for adjusting the elevation of the device above, and the inclination of the device relative to, a reference surface; and body support means for the operator's legs, back, shoulders, arms, and head, said body support means comprising means for adjusting the elevation and/or inclination of a supported body part relative to the reference surface, said body support means comprising a leg and computer support device unit having support means for the user's legs and framework means for suspending said leg support means above a surface on which the apparatus is rested, said framework means being so configured that a user can swing each of his legs to a side beyond and then up onto said leg support means.

4. Apparatus enabling a computer device to be used by an operator in a recumbent position, said apparatus comprising:

support means for said device, said support means having means for adjusting the elevation of the device above, and the inclination of the device relative to, a reference surface; and body support means for the operator's legs, back, shoulders, arms, and head, said body support means comprising means for adjusting the elevation and/or inclination of a supported body part relative to the reference surface, said body support means comprising a leg and computer support device unit having support means for the user's legs and framework means for suspending said leg support means above a surface on which the apparatus is rested, said framework means comprising a single longitudinally oriented component and said leg support means having a leg rest to either side of said longitudinally oriented component.

5. Apparatus enabling a computer device to be used by an operator in a recumbent position, said apparatus comprising:

support means for said device, said support means having means for adjusting the elevation of the device above, and the inclination of the device relative to, a reference surface; and body support means for the operator's legs, back, shoulders, arms, and head, said body support means comprising means for adjusting the elevation and/or inclination of a supported body part relative to the reference surface, said body support means comprising a leg and computer support device unit having:

support means for the user's legs;

framework means for suspending said leg support means above a surface on which the apparatus is rested; and means for so mounting said leg support means to said framework that the elevation of the leg support means above said surface and the inclination of the leg support means relative to that surface can be adjusted by a user of the apparatus.

* * * * *